US011568706B2

(12) United States Patent
Tam

(10) Patent No.: US 11,568,706 B2
(45) **Date of Patent: *Jan. 31, 2023**

(54) GAMING DEVICE HAVING PRIZE LADDER POPULATED WITH INCREMENTABLE PRIZE LEVELS

(71) Applicant: Aristocrat Technologies Australia Pty Limited, North Ryde (AU)

(72) Inventor: Billy Tam, Lindfield (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/398,631

(22) Filed: Aug. 10, 2021

(65) Prior Publication Data

US 2021/0366230 A1 Nov. 25, 2021

Related U.S. Application Data

(63) Continuation of application No. 16/549,355, filed on Aug. 23, 2019, now Pat. No. 11,107,314.

(30) Foreign Application Priority Data

Mar. 19, 2019 (AU) ..... 2019201908

(51) Int. Cl.
*G07F 17/32* (2006.01)
*G07F 17/34* (2006.01)

(52) U.S. Cl.
CPC ..... *G07F 17/3213* (2013.01); *G07F 17/3244* (2013.01); *G07F 17/34* (2013.01)

(58) Field of Classification Search
CPC ... G07F 17/3213; G07F 17/3244; G07F 17/34
See application file for complete search history.

(56) References Cited

U.S. PATENT DOCUMENTS 3,732,559 A 5/1973 Eichelberger
D666,625 S 9/2012 Gilmore
(Continued)

OTHER PUBLICATIONS

Office Action dated Sep. 11, 2020 for U.S. Appl. No. 29/681,390 (pp. 1-9).

(Continued)

*Primary Examiner* — Werner G Garner
(74) *Attorney, Agent, or Firm* — McAndrews, Held & Malloy, Ltd.

(57) ABSTRACT

A gaming device having a processor to control a display to display a set of prize levels having a bottom level, a variable level associated with a variable prize, and an intermediate level. In each of a plurality of game instances, the processor selects a plurality of symbols, control the display to display the selected symbols, determines whether the symbols displayed include increment symbols, upon the symbols displayed including the increment symbols, increments the variable prize by respective amounts of the increment symbols, evaluates symbols displayed for a winning combination, and the symbols displayed including the winning combination, increments from a current prize level to a different prize level in the set of prize levels provided the different prize level is not a top level. At an end of the plurality of game instances, the processor awards a current prize of the current prize level.

20 Claims, 8 Drawing Sheets

(56) References Cited

U.S. PATENT DOCUMENTS

| | | | |
|---|---|---|---|
| D670,726 | S | 11/2012 | Bitran |
| D687,450 | S | 8/2013 | Ghadge |
| D687,451 | S | 8/2013 | Ghadge |
| D689,060 | S | 9/2013 | Tamura |
| D697,940 | S | 1/2014 | Bitran |
| 8,795,059 | B2 | 8/2014 | Aoki et al. |
| D719,970 | S | 12/2014 | Ebtekar |
| D733,176 | S | 6/2015 | Lin |
| D737,320 | S | 8/2015 | McCormick |
| D757,093 | S | 5/2016 | Vonshak |
| D757,785 | S | 5/2016 | Yang |
| D761,839 | S | 7/2016 | Neuman |
| D768,695 | S | 10/2016 | Gagnier |
| D768,696 | S | 10/2016 | Gagnier |
| D774,066 | S | 12/2016 | Kas |
| D783,636 | S | 4/2017 | Lee |
| D794,661 | S | 8/2017 | Nishizawa |
| D806,727 | S | 1/2018 | Park |
| D820,284 | S | 6/2018 | Lee |
| D833,479 | S | 11/2018 | Golden |
| D839,304 | S | 1/2019 | Penacho |
| D865,796 | S | 11/2019 | Lin |
| D875,769 | S | 2/2020 | Penacho |
| D887,442 | S | 6/2020 | Sakata |
| D890,205 | S | 7/2020 | Tsai |
| D890,790 | S | 7/2020 | Marks |
| 2008/0294808 | A1 | 11/2008 | Mahalingam |
| 2013/0151603 | A1 | 6/2013 | Lobb |
| 2013/0281207 | A1 | 10/2013 | Lyons |
| 2014/0094303 | A1 | 4/2014 | Wabschall |
| 2015/0018070 | A1 | 1/2015 | Meyer |
| 2016/0275748 | A1* | 9/2016 | Trainor ..... G07F 17/3258 |
| 2017/0178444 | A1 | 6/2017 | Lee |
| 2017/0242568 | A1 | 8/2017 | Van Der Westhuizen |

OTHER PUBLICATIONS

Office Action dated Jan. 8, 2021 for U.S. Appl. No. 16/549,355 (pp. 1-16).

Notice of Allowance dated Mar. 16, 201 for U.S. Appl. No. 29/681,390 (pp. 1-8).

Grant, Elyot. "Prismata's Arena is Coming!" Prismata Blog, published Mar. 31, 2015 (Retrieved from the Internet Mar. 8, 2021). Internet URL:<blog.prismata.net/2015/03/31/prismatas-arena-is-coming/> (Year: 2015).

Notice of Allowance dated Jun. 24, 2021 for U.S. Appl. No. 16/549,355 (pp. 1-8).

Notice of Allowance dated Jun. 24, 2022 for U.S. Appl. No. 29/797,679 (pp. 1-10).

Hurricane Cash, https://www.youtube.com/watch?v=sF3R8p3uOEQ, retrieved from the internet on Feb. 12, 2019, 1 page.

* cited by examiner

300

| | Reel position | Reel 1 (321) | Reel 2 (322) | Reel 3 (323) | Reel 4 (324) | Reel 5 (325) |
|---|---|---|---|---|---|---|
| 301 | 1 | Pic 1 | 10 | Pic 3 | Q | Pic 1 |
| 302 | 2 | Wild | Q | K | A | 10 |
| 303 | 3 | J | K | 10 | 10 | A |
| 304 | 4 | Q | A | Q | Pic 2 | Pic 2 |
| 305 | 5 | 10 | Pic 2 | K | J | A |
| 306 | 6 | A | 9 | Pic 1 | Wild (331) | Q |
| 307 | 7 | Pic 2 | Wild | J | 9 | K |
| 308 | 8 | A | Pic 3 | K | 10 | Pic 2 |
| 309 | 9 | Q | Q | 9 | A | 9 |
| 310 | 10 | K | 10 | Q | Q | Wild |
| 311 | 11 | J | A | 10 | J | 9 |
| 312 | 12 | 10 | Wild | Wild | K | Q |
| 313 | 13 | Pic 3 | K | A | Wild | 10 |
| 314 | 14 | Wild | J | A | Pic 3 | Wild |
| 315 | 15 | 9 | 10 | Wild | Pic 1 | A |

343 342 341

FIG. 3

GAMING DEVICE HAVING PRIZE LADDER POPULATED WITH INCREMENTABLE PRIZE LEVELS

RELATED APPLICATIONS

The present application is a continuation of and claims priority to U.S. patent application Ser. No. 16/549,355, filed Aug. 23, 2019, and entitled "Gaming Device Having Prize Ladder Populated with Incrementable Prize Levels," which claims priority to Australian Patent Application No. AU 2019201908, filed Mar. 19, 2019, and entitled "Gaming Device With Prize Ladder," and is related to U.S. Design patent application No. 29/681,390, filed Feb. 25, 2019, and entitled "Display Screen or Pair of Display Screens or Portion(s) Thereof with Transitional Graphical User Interface, which are hereby incorporated by reference in its entireties.

BACKGROUND

The present application relates to a gaming device with a prize ladder.

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

Embodiments of the invention provide a gaming device configured to operate so as to display a prize ladder including a variable prize level and initiate a plurality of game instances (e.g. free games). If increment symbols appear during the free games, the variable prize is increased. Each time there is a winning combination, the gaming machine increments the prize level on the prize ladder. At the end of the free games, the gaming machine awards a prize corresponding to the current prize level. If the current prize level is the variable prize level, the award is of the variable prize.

In an embodiment, there is provided a gaming device comprising a display, a processor, and a memory storing symbol data specifying a plurality of selectable symbols including a plurality of increment symbols each defining a prize increment amount, and instructions. When the instructions are executed by the processor, they cause the processor to display a set of prize levels having a bottom level, a top level and at least one intermediate level, wherein a first variable level of the prize levels is associated with a variable prize and initiate a plurality of game instances. In each game instance the processor selects a plurality of symbols from the selectable symbols, displays the selected symbols at a plurality of symbol positions on the display, determines whether the displayed symbols include one or more increment symbols, upon the displayed symbols including one or more increment symbols, increments the variable prize by respective amounts of the one or more increment symbols, evaluates the displayed symbols for any winning combinations, and upon the displayed symbols including at least one winning combination, increments the prize level provided the top level has not already been reached. At the end of the plurality of game instances, the processor awards the current prize level.

In another embodiment, there is provided a method of operating a gaming device comprising a display, a processor and a memory storing symbol data specifying a plurality of selectable symbols including a plurality of increment symbols each defining a prize increment amount. The method comprises controlling the display with the processor to display a set of prize levels having a bottom level, a top level and at least one intermediate level, wherein a first variable level of the prize levels is associated with a variable prize, and initiating, by the processor, a plurality of game instances. In each game instance the processor: selects a plurality of symbols from the selectable symbols, displays the selected symbols at a plurality of symbol positions on the display, determines whether the displayed symbols include one or more increment symbols, upon the displayed symbols including one or more increment symbols, increments the variable prize by respective amounts of the one or more increment symbols, evaluates the displayed symbols for any winning combinations, and upon the displayed symbols including at least one winning combination, increments the prize level provided the top level has not already been reached. At the end of the plurality of game instances, the processor awards the current prize level.

In an embodiment, there is provided a gaming system comprising a display, one or more processors, and at least one memory storing symbol data specifying a plurality of selectable symbols including a plurality of increment symbols each defining a prize increment amount, and instructions. When the instructions are executed by the one or more processors, they cause the one or more processors to display a set of prize levels having a bottom level, a top level and at least one intermediate level, wherein a first variable level of the prize levels is associated with a variable prize and initiate a plurality of game instances. In each game instance the one or more processors selects a plurality of symbols from the selectable symbols, displays the selected symbols at a plurality of symbol positions on the display, determines whether the displayed symbols include one or more increment symbols, upon the displayed symbols including one or more increment symbols, increments the variable prize by respective amounts of the one or more increment symbols, evaluates the displayed symbols for any winning combinations, and upon the displayed symbols including at least one winning combination, increments the prize level provided the top level has not already been reached. At the end of the plurality of game instances, the one or more processors awards the current prize level.

BRIEF DESCRIPTION OF THE DRAWINGS

FIG. 3 illustrates an example reel layout.

DETAILED DESCRIPTION

Figure 1:
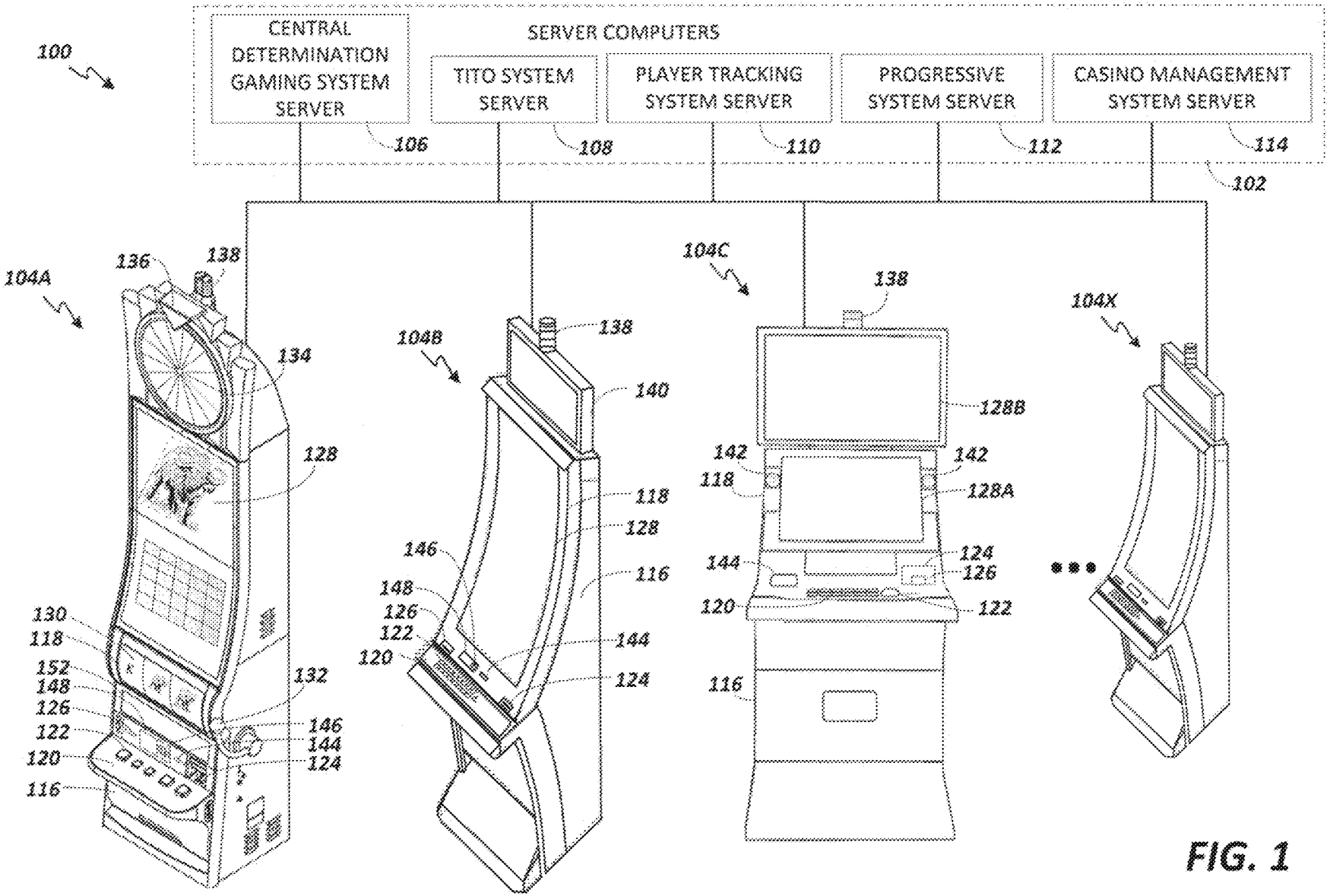
FIG. 1 is an exemplary diagram showing several EGMs networked with various gaming related servers.

FIG. 1 illustrates several different models of EGMs which may be networked to various gaming related servers. The present invention can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices such as, but not limited to, a smart phone, a tablet, a laptop, or a game console.

Communication between the gaming devices 104A-104X and the server computers 102, and among the gaming devices 104A-104X, may be direct or indirect, such as over the Internet through a web site maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the present invention may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 116 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming device 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A. In some embodiments a ticket reader can be used which is only capable of reading tickets. In some embodiments, a different form of token can be used to store a cash value, such as a magnetic stripe card.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking server system 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a backlit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
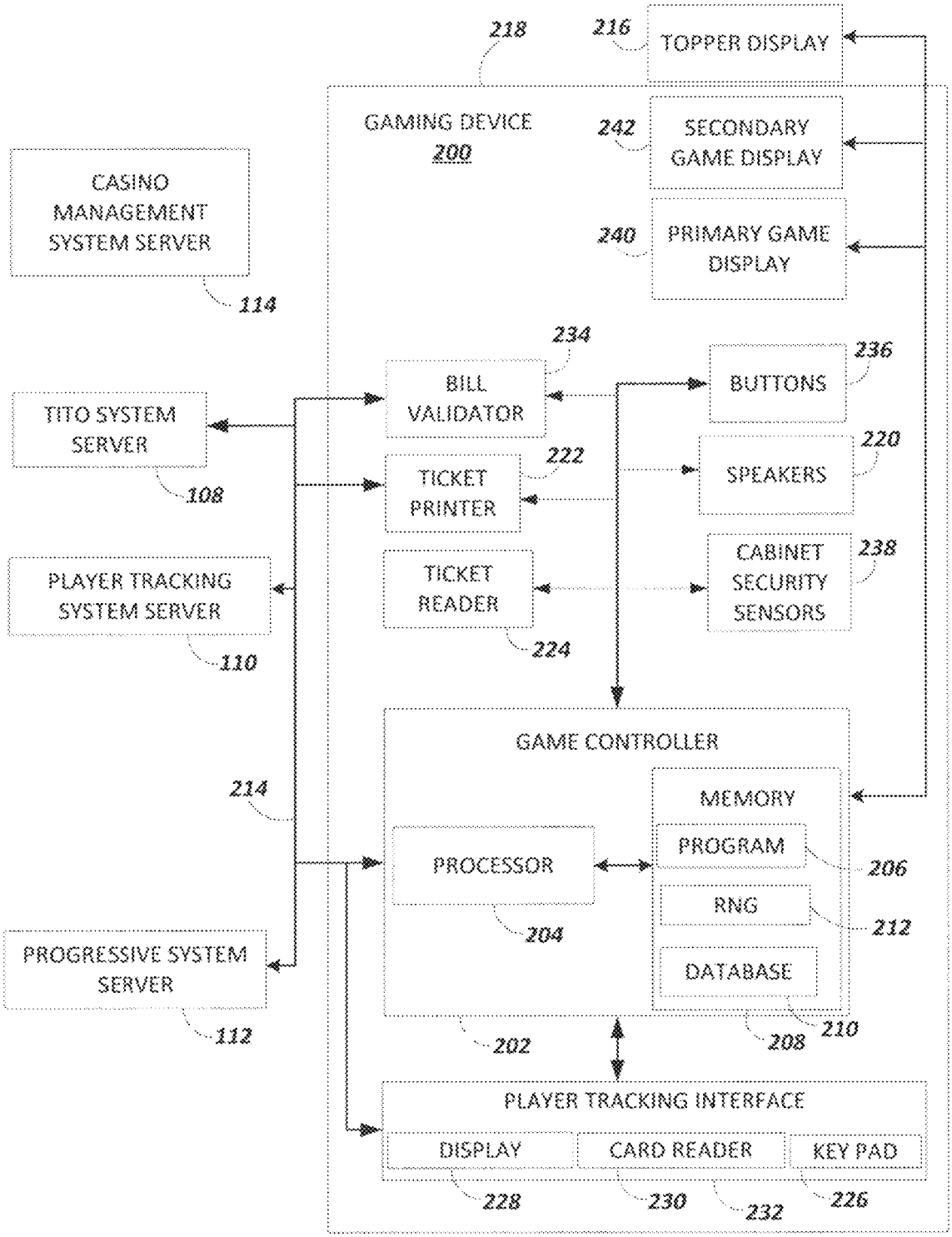
FIG. 2 is a block diagram showing various functional elements of an exemplary EGM.

Many or all the above-described components can be controlled by circuitry (e.g., a gaming controller) housed inside the main cabinet 116 of the gaming device 104A, the details of which are shown in FIG. 2.

Note that not all gaming devices suitable for implementing embodiments of the present invention necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 118 which opens to provide access to the interior of the gaming device 104B. The main or service door 118 is typically used by service personnel to refill the ticket-out printer 126 and collect bills and tickets inserted into the bill validator 124. The door 118 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. The game or games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance. In some embodiments, the random number generator 212 is a pseudo-random number generator.

Alternatively, a game instance (i.e. a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher (or another form of readable token) through an appropriate input device such as coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other input device which enables a player to input information into the gaming device 200. In some embodiments, a player's selection may apply across a plurality of game instances. For example, if the player is awarded additional game instances in the form of free games, the player's prior selection of the amount bet per line and the number of lines played may apply to the free games. The selections available to a player will vary depending on the embodiment. For example, in some embodiments a number of pay lines may be fixed. In other embodiments, the available selections may include different numbers of ways to win instead of different numbers of pay lines.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance using an appropriate output device that can output at least one of physical currency and a token representing currency (typically by pressing a cash out button to receive a ticket from the ticket printer 222). The ticket may be "cashed-in" for money or inserted into another machine to establish a credit balance for play.

Figure 5:
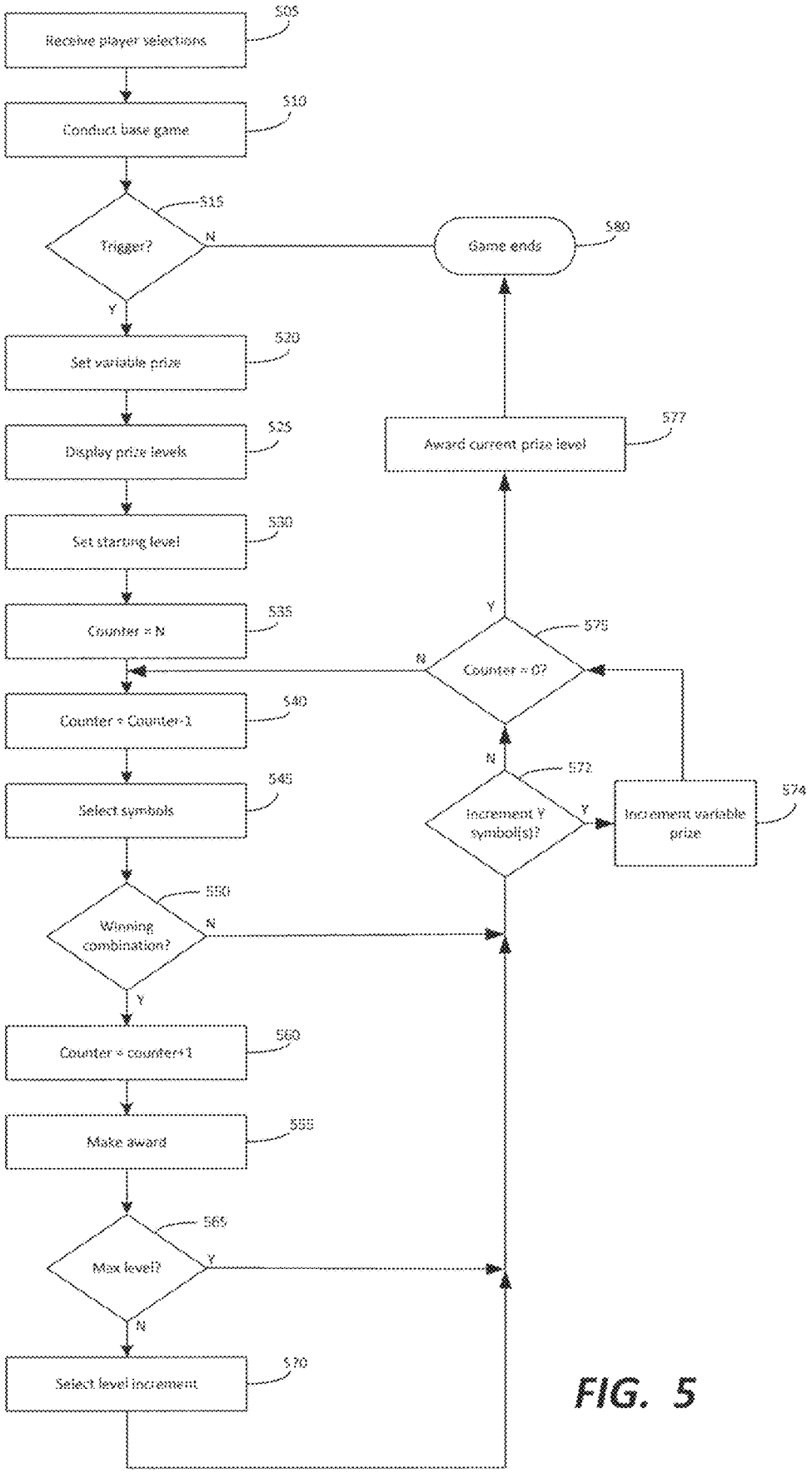
FIG. 5 is a flow chart of an embodiment of a gaming method carried out by a processor.

FIG. 5 illustrates an embodiment of a gaming method 500 carried out by the processor 204 when the processor 204 executes program code 206 in memory 208. At step 505, the processor receives player selections as described above.

At step 510, the processor 204 conducts a base game instance. In one example, the base game instance is a reel-based game.

FIG. 3 illustrates an example of a set 300 of five-reel strips 321, 322, 323, 324, 325. In the example, each reel strip has fifteen-reel strip positions 301-315. Each reel strip position of each reel has a symbol. For example, a "Wild" symbol 331 occupies the sixth reel strip position 306 of the fourth reel 324. Other reels strips to those illustrated in FIG. 3 can be used, for example, reel strips where two or more wild symbols are placed at consecutive reel strip positions of a reel strip. In other examples, the reel strips could have between 30 and 100-reel strip positions. The length of the reel strips depend on factors such as the number of wild symbols (in general, the more wilds there are, the longer the reel strip needs to be to maintain the target RTP), and volatility (in general, the higher the prize value is, the longer the reel strip needs to be to lower the hit rate to maintain the target RTP).

Figure 4:
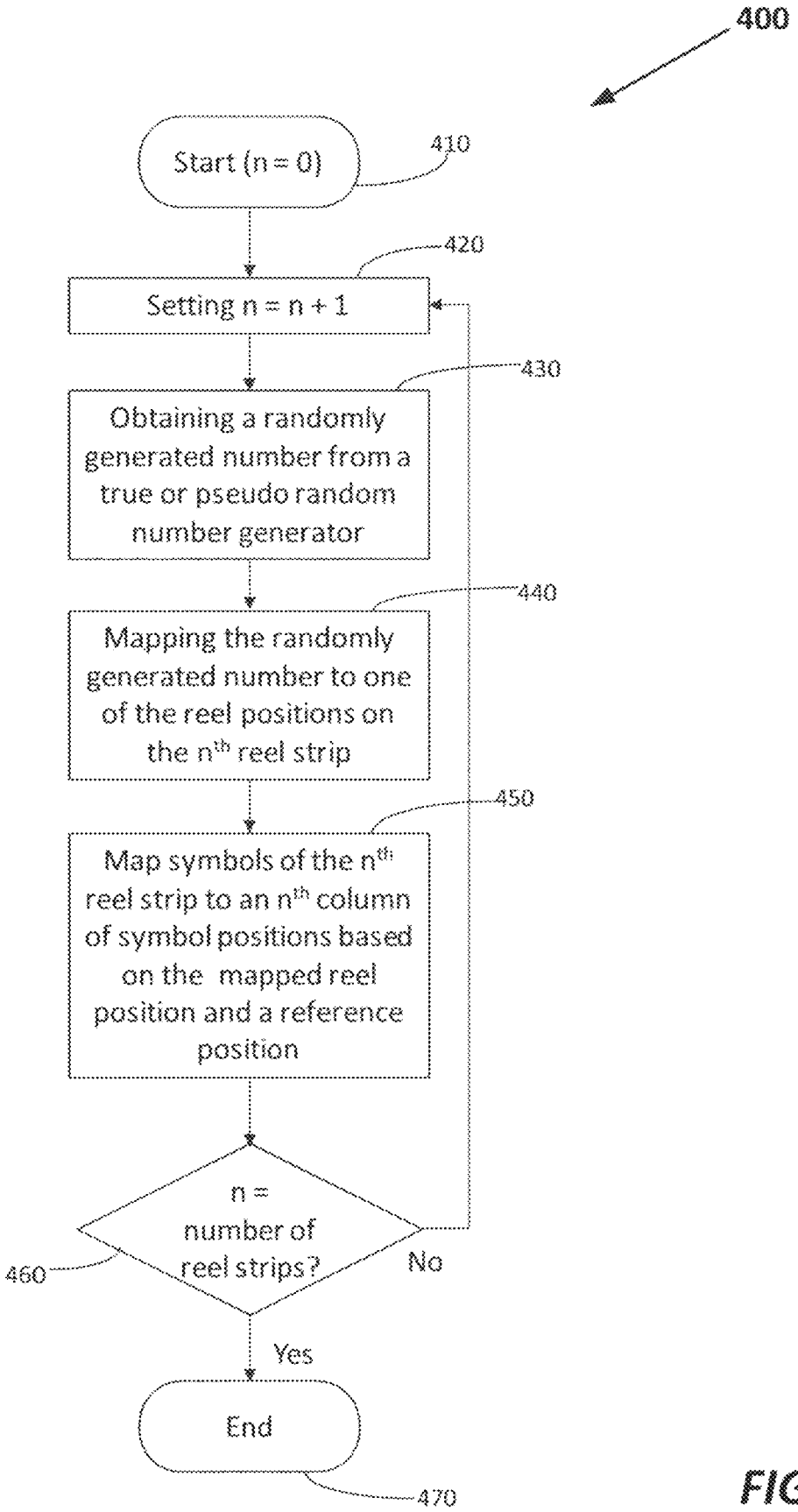
FIG. 4 is a flow chart of an example symbol selection process.

FIG. 4 is a flow chart of a method 400 carried out by the processor 204 to select symbols from reel strips. At step 410, the processor 204 starts the process of selecting symbols with a counter (n) set at zero as symbols have not yet been selected from any reel strips. At step 420, the processor 204 increments the counter. In the first iteration, the counter is set to 1 to reflect that symbols are to be selected from a first reel strip. At step 430, the processor obtains a randomly generated number from a true or pseudo random number generator 212. At step 440, the processor maps the generated number to one of the reel positions of the nth reel strip. In the first iteration, this is the first reel strip. To map the generated number to one of the reel positions, the possible values that can be returned from the RNG 212 are divided into ranges and associated with specific ones of the reel positions in memory 208. In one example, these ranges are stored as a look-up table. In one example, the ranges are each the same size so that each of the reel strip positions has the same chance of been selected. In other examples, the ranges may be arranged to weight the relative chances of selecting specific reel strip positions. The reel strips may be of different lengths.

At step 450, the processor 204 maps symbols of the nth reel strip to an nth column of symbol display positions based on the mapped reel position and a reference position. In an example, the reference position is the bottom position of the symbol positions of each column of symbol positions. In this example, the selected reel position (and hence the symbol at this position) is mapped to the bottom symbol position of the column. In an example, there are two other symbol positions in the column of symbol positions and hence symbols at two neighboring reel strip positions are also mapped to the symbol positions of the column. Referring to the example reel strips of FIG. 3, if the value returned by the RNG 212 is mapped to reel position 313, then for the first reel strip 321, "Pic3" symbol 343 is mapped to a bottom symbol position, "10" symbol 342 is mapped to a middle symbol position, and "J" symbol is mapped to a top symbol position.

At step 460, the processor 460 determines whether symbols have been selected for all of the reel strips, and if not, the processor reverts to step 420 and iterates through steps 430, 440 and 450 until it is determined at step 460 that symbols have been selected from all n reel strips and mapped to all n columns of symbol positions after which the symbol selection process ends 470. Different numbers of symbols may be mapped to different numbers of symbol positions.

After the symbols of all reel strips have been mapped to symbol position, the processor 204 controls display 240 to display them at the symbol positions. The processor 204 then evaluates the displayed symbols based on a pay table stored in memory 208 and the player's selections (e.g. the player's selected number of ways to win).

In embodiments of the invention, the displayed are also evaluated to determine whether a trigger condition is met at step 515 (of FIG. 5) in order to determine whether to trigger a feature game.

If there is no trigger at step 515, the game ends 580.

If there is a relevant feature trigger at step 515, at step 520, the processor 204 sets a variable prize level. In the example, the processor sets a variable prize level based on a current wager value.

Figure 6:
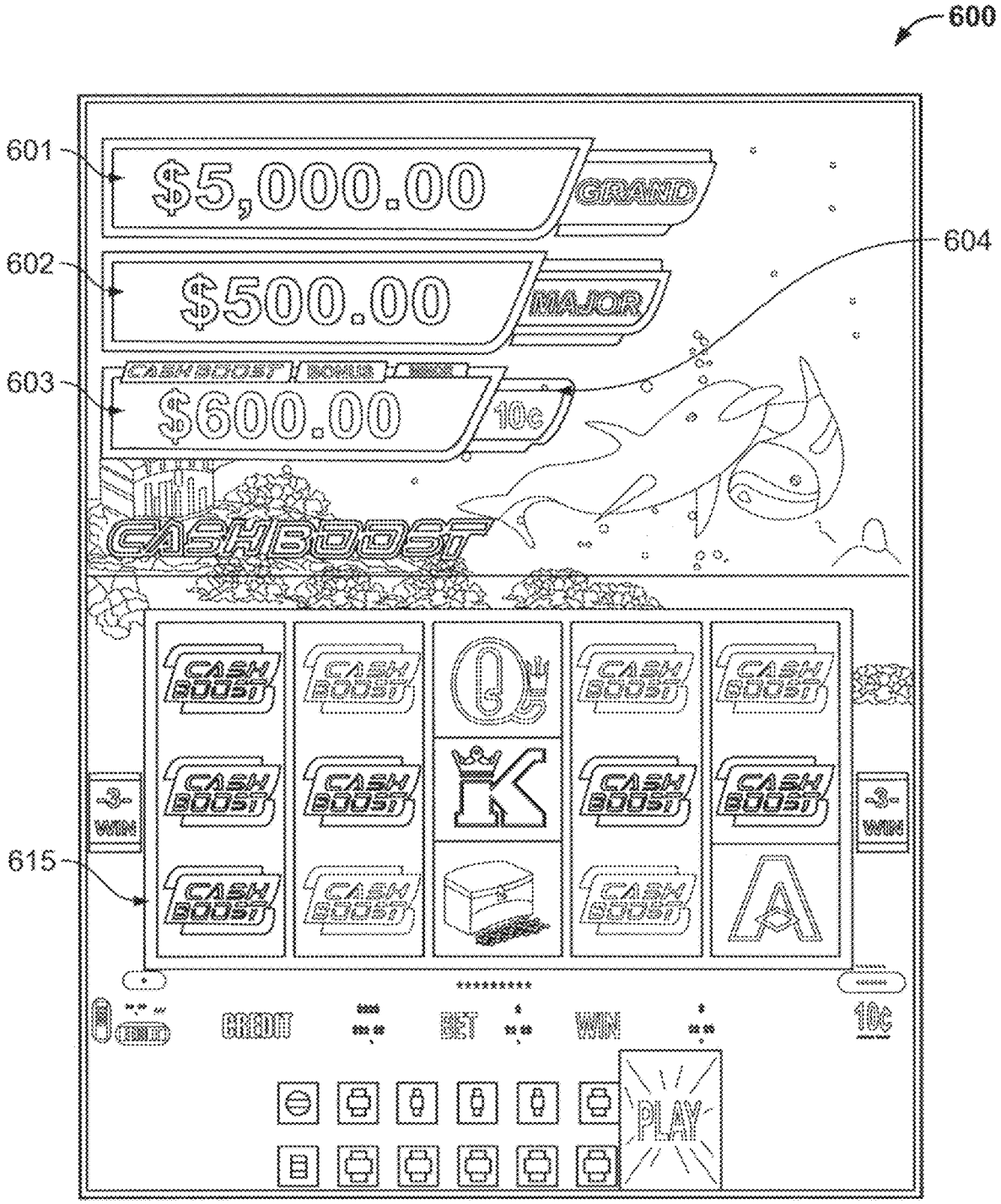
FIGS. 6-8 are screen displays of an example of implementing the method of FIG. 5.

Referring to FIG. 6, there is shown an example screen display 600 of an embodiment prior to a feature game being triggered. Symbols are displayed at a set of display positions 615. Above the displayed symbols are displayed a series of prizes, for example on display 240 or secondary display 242. In the example of FIG. 6 there is shown a grand prize 601 of $5,000, a major prize 602 of $500 and a "cash boost bonus/minor prize" 603 of $600 which is based on a current wager amount of 10 credits 604. The "cash boost bonus/minor prize" 603 can be a progressive jackpot prize which is also awarded for a minor jackpot.

Figure 7:
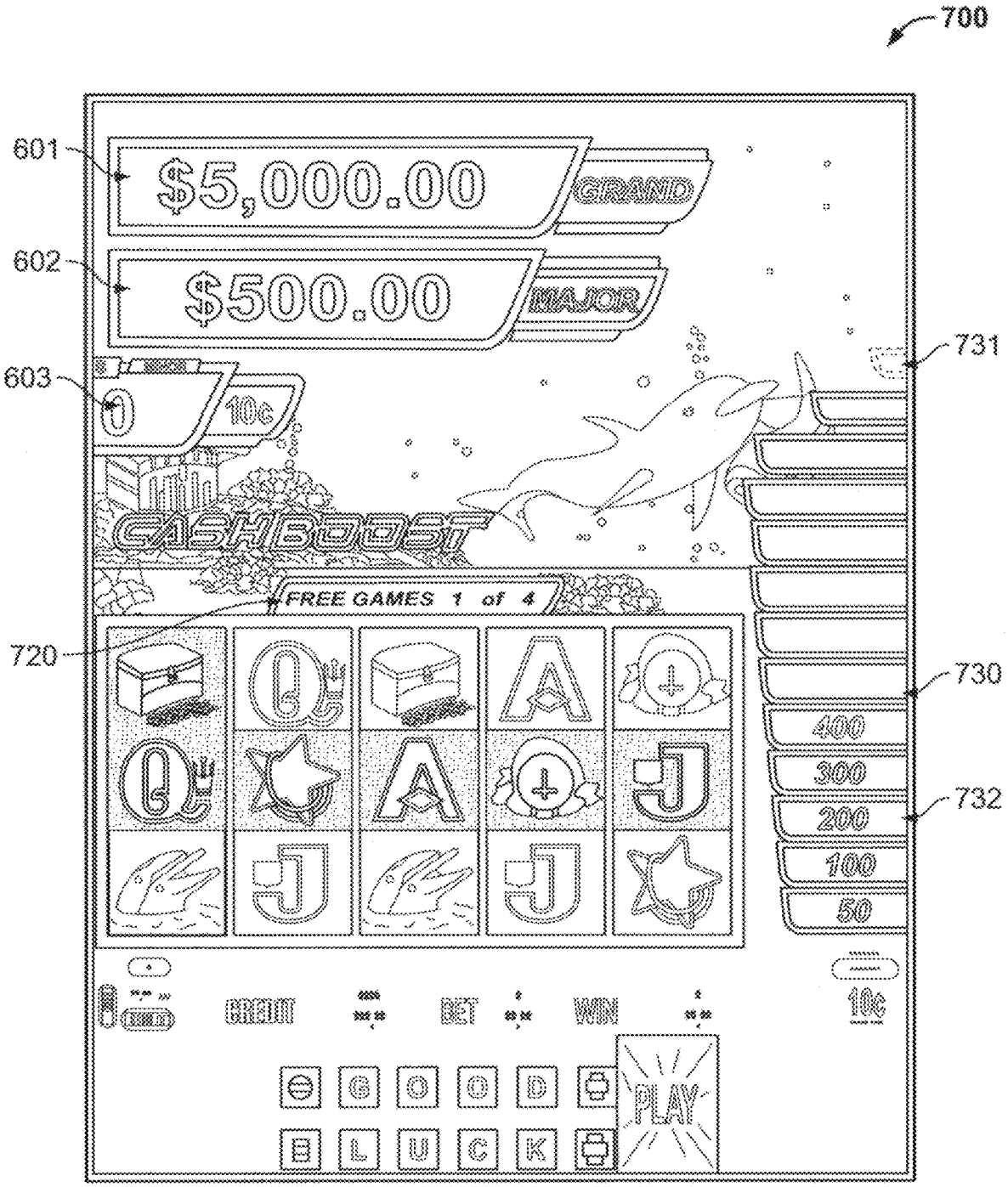

Referring to FIG. 7, as the feature game is triggered, the "cash boost bonus/minor prize" 603 is used to set the variable prize level. FIG. 7 shows that a series of game instances has been triggered and a free game counter 720 has been added to the screen display 700. In this example, that a first free game of four is about to be conducted. A prize ladder 730 comprising a set of prize levels is in the process of being added in the screen display 700 of FIG. 7. In this respect, for example, level 731 is not completely displayed and level 731 and several prize levels below it are yet to be populated with prize values, while prize level 732 has been populated with the value 200 credits.

It will also be apparent that the cash boost prize 603 is in the process of being removed from the display.

Figure 8:
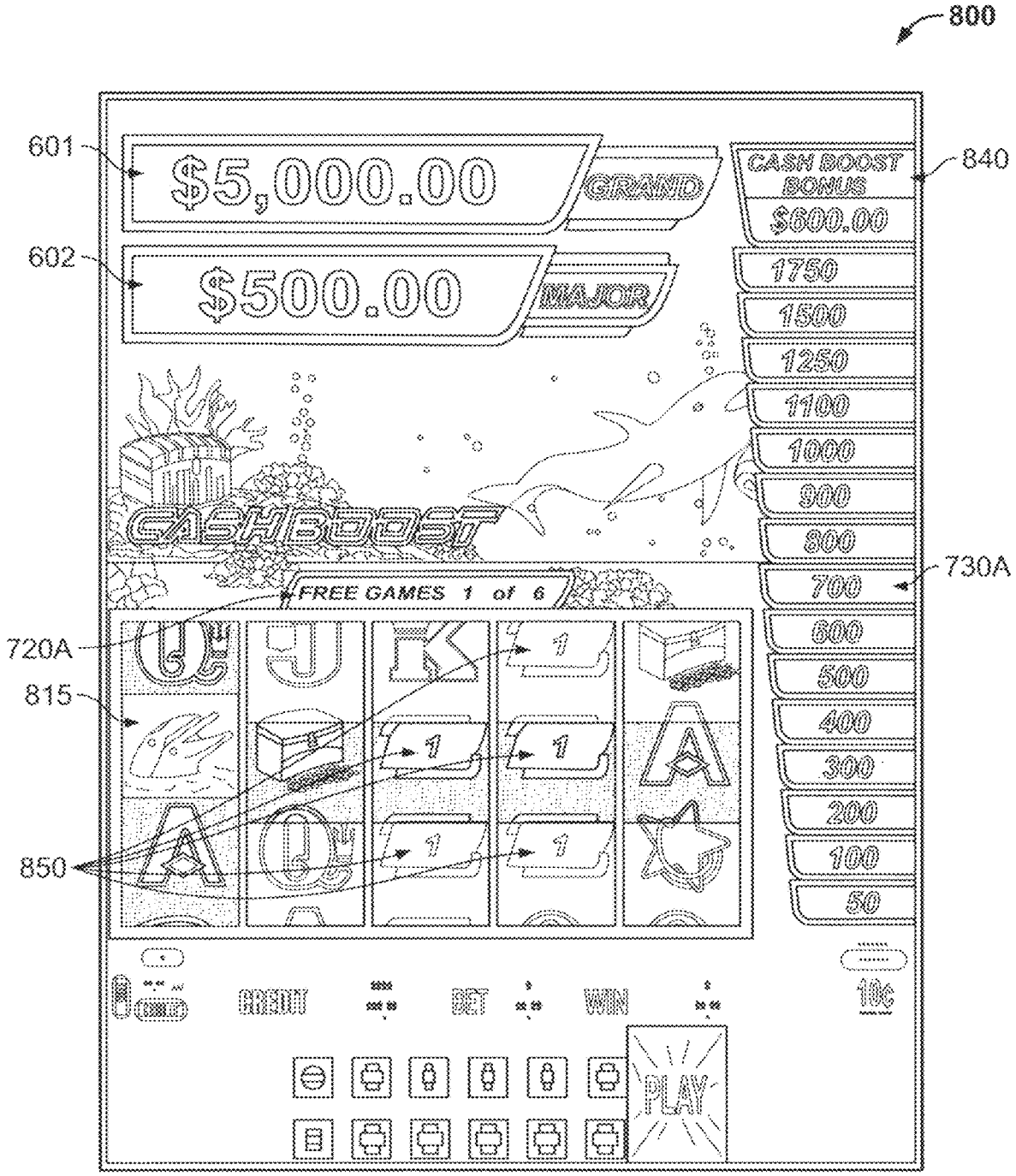

Referring to FIG. 8, the "cash boost bonus/minor prize" 603 (of FIG. 6) is now shown as a variable prize 840 at the top of the set of prize values. That is the cash boost bonus prize 840 is both a variable level prize and the top-level prize of the updated prize ladder 730A which now shows all the available prizes. The screen display 800 also shows that the number of free games has been updated due to play of the game to show that we are in one of six free games 720A. This is a result of at least two additional free games being awarded.

FIG. 8 also shows five "cash on reels" symbols 850 having the value of $1.00. The selection of these symbols results in $5.00 being added to the cash boost bonus so that it takes the new value of $605 in the next free game. In this way, the variable prize 840 increments.

Referring again to FIG. 5 and with continued reference to FIGS. 6-8, it will be apparent that at step 525, the processor 204 controls the display 240 to display the prize levels 525. The processor also sets a starting level 530.

In an embodiment, the starting level is set by the processor 204 selecting using a weighted table and the random number generator, to determine whether the starting level should be the bottom level, next from bottom level or second from bottom level. That is, in the weighted table, values that can be returned from the random number generator are associated with different starting levels and the starting level is set in dependence on the value returned from the random number generator.

At step 535, the processor sets a counter to an initial number of game instances (or "free games"). The initial number of game instances may be fixed or may be related to the number of symbols that cause the feature game to trigger.

At step 540, a game instance has begun to be carried out and the counter is decreased by one. Each game instance involves, at step 545, selecting symbols for display at the set of display positions. For example, the 15 symbol display positions shown in FIG. 6.

At step 550, the processor 204 determines whether the selected symbols include any winning combinations based on the pay table. If there are any winning combinations, at step 555, the processor 204 make an award of the amount specified in the pay table based on the player's wager and the player's selections and adds the winning amount to the win meter in the memory 208.

At step 560, in this example, if there is a winning combination, the processor increases the number of game instances to be carried out by one game instance. In other examples, there may be no increment to the number of game instances or more than one game instance may be added to the counter.

At step 565, the processor determines whether the current prize level is the maximum prize level. If it is not, then the processor selects a prize level increment at step 570. In an example, the processor selects between an increment of 1, 2 or 3 prize levels using a weighted table and the random number generator. That is, respective sub-ranges of values that can be returned from the random number generator are assigned to increments of 1, 2 and 3 levels. For example, 60% of the possible values that can be returned from the random number generator are assigned to an increment of 1 level, 30% to an increment of 2 levels and 10% to an increment of 3 levels.

At step 575, the processor 204 determines whether the counter has reached zero. If it has not, the processor 204 returns to step 540 to carry out a further game instance. If, at step 565, the processor 204 has determined that the maximum award level has been reached, then the processor 204 still conducts any remaining game instances even though the maximum level has been reached. In these game instances, the processor 204 will still increment the variable prize level if any increment symbols are selected. That is, irrespective of whether there is a winning combination in the game round or whether the next level has been reached at step 572, it is determined whether there are any increment symbols and if there are, at step 574, the processor increments the variable prize based on the value shown on the increment symbols and this process continues event if the maximum level has been reached. Once the counter reaches zero at step 575 indicating that all of the free game instances have been carried out, at step 577, the processor awards the current prize level before the game ends 580.

An example embodiment provides a gaming device comprising: a display; a processor; and a memory storing a) symbol data specifying a plurality of selectable symbols including a plurality of increment symbols each defining a prize increment amount, and b) instructions which when executed by the processor, cause the processor to: a) display a set of prize levels having a bottom level, a top level and at least one intermediate level, wherein a first variable level of the prize levels is associated with a variable prize; b) initiate a plurality of game instances and in each game instance: select a plurality of symbols from the selectable symbols, display the selected symbols at a plurality of symbol positions on the display, determine whether the displayed symbols include one or more increment symbols, upon the displayed symbols including one or more increment symbols, increment the variable prize by respective amounts of the one or more increment symbols, evaluate the displayed symbols for any winning combinations, and upon the displayed symbols including at least one winning combination, increment the prize level provided the top level has not already been reached; and c) at the end of the plurality of game instances, award the current prize level.

In an embodiment, when the instructions are executed by the processor, they cause the processor to conduct a base game, determine whether a trigger condition is met in the base game, and, initiate the plurality of game instances responsive to the trigger condition being met.

In an embodiment, when the instructions are executed by the processor, they cause the processor to set an initial value of the variable prize responsive to the trigger condition being met.

In an embodiment, when the instructions are executed by the processor, they cause the processor to set the initial value of the variable prize to a current value of a progressive jackpot prize.

In an embodiment, the first variable level of the prize levels is the top level.

In an embodiment, incrementing the prize level comprises selecting, from a set of prize level increments, a number of prize levels to increment the prize level by.

In an embodiment, the set of prize level increments comprises one level, two levels and three levels.

In an embodiment, when the instructions are executed by the processor, they cause the processor to select the number of prize levels from a weighted table.

In an embodiment, when the instructions are executed by the processor, they cause the processor to select a starting level from a set of starting levels.

In an embodiment, the set of starting levels are the bottom level, a second level and a third level.

In an embodiment, when the instructions are executed by the processor, they also cause the processor to award an additional game instance upon the displayed symbols including at least one winning combination.

Another example embodiment provides a method of operating a gaming device comprising: a display, a processor and a memory storing symbol data specifying a plurality of selectable symbols including a plurality of increment symbols each defining a prize increment amount, the method comprising: a) controlling the display with the processor to display a set of prize levels having a bottom level, a top level and at least one intermediate level, wherein a first variable level of the prize levels is associated with a variable prize; b) initiating, by the processor, a plurality of game instances and in each game instance the processor: selecting a plurality of symbols from the selectable symbols, displaying the selected symbols at a plurality of symbol positions on the display, determining whether the displayed symbols include one or more increment symbols, upon the displayed symbols including one or more increment symbols, incrementing the variable prize by respective amounts of the one or more increment symbols, evaluating the displayed symbols for any winning combinations, and upon the displayed symbols including at least one winning combination, incrementing the prize level provided the top level has not already been reached; and c) at the end of the plurality of game instances, awarding, by the processor, the current prize level.

In an embodiment, the method comprises the processor conducting a base game, determining whether a trigger condition is met in the base game, and, initiating the plurality of game instances responsive to the trigger condition being met.

In an embodiment, the method comprises the processor setting an initial value of the variable prize responsive to the trigger condition being met.

In an embodiment, the method comprises the processor setting the initial value of the variable prize to a current value of a progressive jackpot prize.

In an embodiment, the first variable level of the prize levels is the top level.

In an embodiment, the processor increments the prize level by selecting, from a set of prize level increments, a number of prize levels to increment the prize level by.

In an embodiment, the set of prize level increments comprises one level, two levels and three levels.

In an embodiment, the processor selects the number of prize levels from a weighted table.

In an embodiment, the processor selects a starting level from a set of starting levels.

In an embodiment, the set of starting levels are the bottom level, a second level and a third level.

In an embodiment, the processor awards an additional game instance upon the displayed symbols including at least one winning combination.

Another example embodiment provides a gaming system comprising: a display; one or more processors; and at least one memory storing a) symbol data specifying a plurality of selectable symbols including a plurality of increment symbols each defining a prize increment amount, and b) instructions which when executed by the one or more processors, cause the one or more processors to: a) display a set of prize levels having a bottom level, a top level and at least one intermediate level, wherein a first variable level of the prize levels is associated with a variable prize; b) initiate a plurality of game instances and in each game instance: select a plurality of symbols from the selectable symbols, display the selected symbols at a plurality of symbol positions on the display, determine whether the displayed symbols include one or more increment symbols, upon the displayed symbols including one or more increment symbols, increment the variable prize by respective amounts of the one or more increment symbols, evaluate the displayed symbols for any winning combinations, and upon the displayed symbols including at least one winning combination, increment the prize level provided the top level has not already been reached; and c) at the end of the plurality of game instances, award the current prize level.

Another example embodiment provides computer program code which when executed causes a processor to implement the above method.

Another example embodiment provides non-transitory computer readable medium comprising the computer program code.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. A gaming device comprising:

a display screen operable to display a matrix of display positions; and a game controller comprising a processor and a memory storing a) a set of selectable symbols including a plurality of increment symbols respectively identified by a plurality of increment amounts, and b) instructions, which, when executed by the processor, cause the processor to at least:

control the display screen to display a series of prizes including a variable prize identified by a variable prize amount, in response to a trigger condition being met, remove the variable prize from the series of prizes from the display screen, resize the matrix of display positions resulting in a resized matrix of display positions, add progressively to the display screen a prize ladder having a plurality of levels that include a variable prize level, including populating the variable prize level with the variable prize amount, and set a current level on the prize ladder, control the resized matrix of display positions to respectively display a plurality of selectable symbols selected based on one or more random numbers from a random number generator, when the plurality of selectable symbols selected include a first increment symbol of the plurality of increment symbols, add to the variable prize amount on the variable prize level a first increment identified on the first increment symbol, and when the plurality of selectable symbols selected include a winning outcome, set the current level to a higher level on the prize ladder provided the current level is not a top level.

2. The gaming device of claim 1, wherein the instructions, when executed, cause the processor to set a starting level as the current level when the trigger condition is met, using at least one of the random number generator and a weighted table.

3. The gaming device of claim 2, wherein the instructions, when executed, cause the processor to set a bottom level as the starting level.

4. The gaming device of claim 1, wherein the instructions, when executed, cause the processor to set the variable prize level as the top level of the prize ladder.

5. The gaming device of claim 1, wherein the instructions, when executed, cause the processor to add a level increment to the current level resulting in the higher level.

6. The gaming device of claim 5, wherein the instructions, when executed, cause the processor to select the level increment based on at least one of a weighted table and the random number generator.

7. The gaming device of claim 1, wherein the variable prize level is the top level on the prize ladder.

8. A method of controlling prizes being awarded on a gaming device having a display screen operable to display a matrix of display positions, and a game controller comprising a processor and a memory storing a) a set of selectable symbols including a plurality of increment symbols respectively identified by a plurality of increment amounts, and b) instructions, which, when executed by the processor, cause the processor to control the display screen to display a series of prizes including a variable prize identified by a variable prize amount, the method comprising:

displaying the variable prize from the series of prizes being removed from the display screen;

progressively displaying a prize ladder having a plurality of levels that includes a variable prize level, including populating the variable prize level with the variable prize amount from the series of prizes;

displaying at the matrix of display positions respectively a plurality of selectable symbols selected based on one or more random numbers from a random number generator and a weighted table;

when the plurality of selectable symbols selected include a first increment symbol of the plurality of increment symbols, displaying a first increment identified on the first increment symbol being added to the variable prize amount on the variable prize level; and when the plurality of selectable symbols selected include a winning outcome, setting a current level to a higher level on the prize ladder provided the current level is not a top level.

9. The method of claim 8, further comprising using at least one of the random number generator and the weighted table to set a starting level as the current level while progressively displaying the prize ladder.

10. The method of claim 9, further comprising identifying a bottom level as the starting level.

11. The method of claim 8, further comprising identifying the variable prize level as the top level of the prize ladder.

12. The method of claim 8, further comprising adding a level increment to the current level resulting in the higher level.

13. The method of claim 12, further comprising selecting the level increment based on at least one of the weighted table and the random number generator.

14. A non-transitory computer-readable medium comprising i) a set of selectable symbols including a plurality of increment symbols respectively identified by a plurality of increment amounts, ii) a plurality of weighted tables, and iii) one or more sequences of instructions, for conducting a game on a gaming system including a display screen and a game controller, the one or more sequences of instructions, which, when executed, cause a processor to perform the steps of:

controlling the display screen to display a series of prizes including a variable prize identified by a variable prize amount;

in response to a trigger condition being met, removing the variable prize from the series of prizes from the display screen, and controlling the display screen to progressively display a prize ladder having a plurality of levels that include a variable prize level, including populating the variable prize level with the variable prize amount;

controlling the display screen to display a plurality of selectable symbols selected based on one or more random numbers from a random number generator and at least one of the weighted tables;

when the plurality of selectable symbols selected include a first increment symbol of the plurality of increment symbols, adding to the variable prize amount on the variable prize level a first increment identified on the first increment symbol; and when the plurality of selectable symbols selected include a winning outcome, updating the prize ladder to identify to a higher level provided the higher level is not a top level.

15. The non-transitory computer-readable medium of claim 14, wherein the one or more sequences of instructions, when executed, cause the processor to perform the step of setting a starting level as a current level while displaying the prize ladder, using at least one of the random number generator and the at least one of the weighted tables.

16. The non-transitory computer-readable medium of claim 15, wherein the one or more sequences of instructions, when executed, cause the processor to perform the step of identifying a bottom level as the starting level.

17. The non-transitory computer-readable medium of claim 14, wherein the one or more sequences of instructions, when executed, cause the processor to perform the step of identifying the variable prize level as the top level of the prize ladder.

18. The non-transitory computer-readable medium of claim 14, wherein the one or more sequences of instructions, when executed, cause the processor to perform the step of adding a level increment to a current level resulting in the higher level.

19. The non-transitory computer-readable medium of claim 18, wherein the one or more sequences of instructions, when executed, cause the processor to perform the step of selecting the level increment based on the at least one of the weighted tables and the random number generator.

20. The non-transitory computer-readable medium of claim 14, wherein the variable prize level is the top level on the prize ladder.

* * * * *